United States Patent [19]

Rieger et al.

[11] Patent Number: 5,020,437

[45] Date of Patent: Jun. 4, 1991

[54] AMMUNITION SHELL FORMING A STACK OF MULTIPLE PROJECTILES

[75] Inventors: Ulrich Rieger, Feldkirchen/Westerham; Dieter Kalus, Munich, both of Fed. Rep. of Germany

[73] Assignee: Messerschmitt-Boelkow-Blohm GmbH, Munich, Fed. Rep. of Germany

[21] Appl. No.: 397,759

[22] Filed: Aug. 23, 1989

[30] Foreign Application Priority Data

Aug. 23, 1988 [DE] Fed. Rep. of Germany ..... 3828501

[51] Int. Cl.[5] ..... F42B 12/58

[52] U.S. Cl. ..... 102/489; 102/357; 102/511

[58] Field of Search ..... 102/489, 438, 505, 340, 102/342, 351, 357, 511

[56] References Cited

U.S. PATENT DOCUMENTS

| | | | |
|---|---|---|---|
| 1,776,755 | 9/1930 | Driggs, Jr. et al. | 102/340 |
| 2,360,473 | 10/1944 | Calkins | 102/511 |
| 3,956,990 | 5/1976 | Rowe | 102/494 |
| 4,342,262 | 8/1982 | Romer et al. | 102/489 |
| 4,505,202 | 3/1985 | Fidler et al. | 102/357 |
| 4,669,386 | 6/1987 | Precoul et al. | 102/489 |
| 4,754,706 | 7/1988 | Fauvel et al. | 102/489 |

FOREIGN PATENT DOCUMENTS

| | | | |
|---|---|---|---|
| 2607336 | 7/1982 | Fed. Rep. of Germany | 102/489 |
| 6415224 | 7/1965 | Netherlands | 102/340 |

*Primary Examiner*—Deborah L. Lyle
*Assistant Examiner*—Stephen Johnson
*Attorney, Agent, or Firm*—W. G. Fasse; D. H. Kane, Jr.

[57] ABSTRACT

A plurality of separate projectiles is held together in a multiple shell or cluster shell, in the form of a stack. At least two parallel springy flat bands (7) extend lengthwise around the stack. The flat bands (7) are looped around the front end and the free band ends engage the rare end of the stack with hooks (9). A tensioning element engages and holds the hooks (9) and thus the bands (7) tightly to the stack. After the shell is fired the tensioning element is served, e.g. by a cutter (19) so that the flat bands (7) spring or flare open to release and distribute the separate projectiles. The release means is equipped to either cause release immediately after the shell has left the firing tube (4) or with a delay. A front end plate (16) and a rear end plate (17) may be arranged at the ends of the stack. Intermediate plates (26) may be arranged between adjacent projectiles. Parachutes may be provided to pull the separate projectiles from the shell stack in sequence as the projectile bodies are released by the flat springy bands in order to realize with the separate projectile bodies various desired impact scatter or cluster patterns on ground.

21 Claims, 5 Drawing Sheets

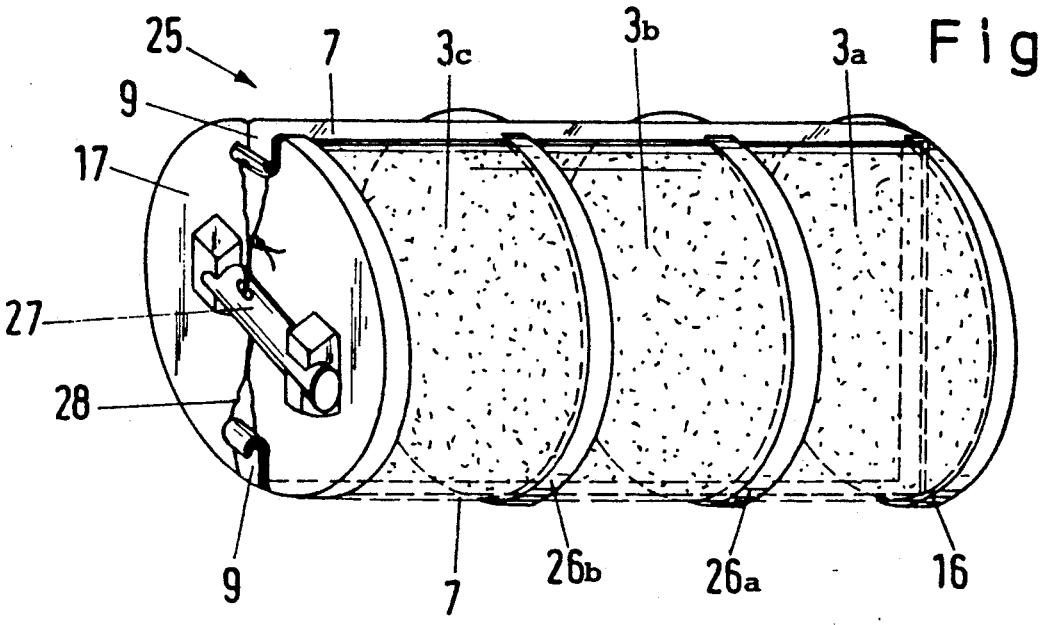
Fig.5
Fig.6
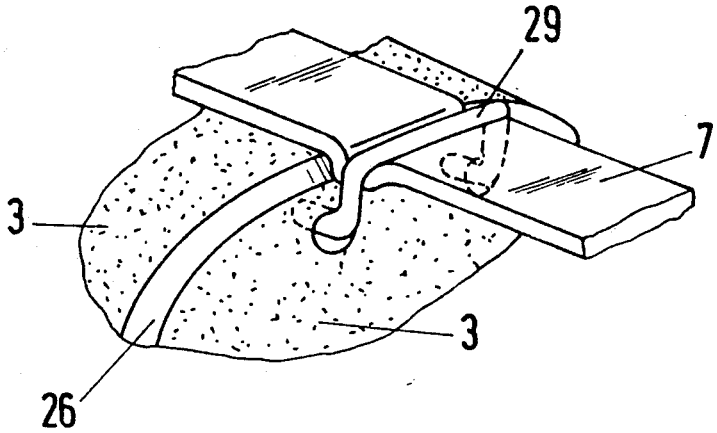
Fig.7
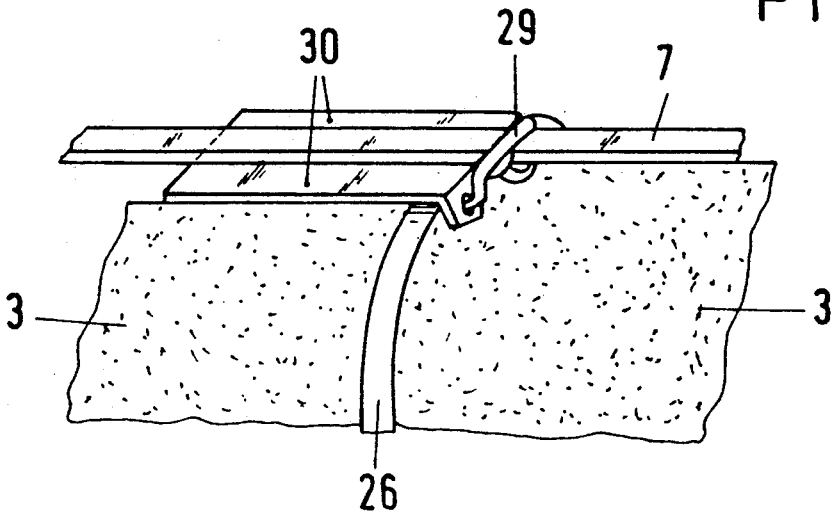

35
36
38
39
26
26
35
37
36
17
16
7
40
7
40
7
40
41
3
3
3
41
42
41
40
41
42

AMMUNITION SHELL FORMING A STACK OF MULTIPLE PROJECTILES

FIELD OF THE INVENTION

The invention relates to an ammunition shell which comprises a plurality of separate projectiles held together in the form of a stack by at least two parallel holding straps looping around one end of the stack to be fired from a firing tube such as a cannon or mortar barrel.

BACKGROUND INFORMATION

German Patent Publication (DE-OS) 2,607,336 describes a multiple projectile ammunition shell or stack of the above described general type. In the known stack multiple projectiles are enclosed by a carrier projectile, whereby the holding members holding together the separate ammunition bodies comprise half shells forming the carrier projectile casing or jacket. The half shells are held together at the bottom of the shell by two foldable control fins connected by hinges to the shell bottom. A burst charge is provided in the nose cone of the shell above the stack of projectile bodies. The bursting charge is ignited after the shell has left the firing tube or barrel, whereby the shell nose cone together with its igniter is blasted away from the shell. Thereupon, the foldable control fins and the half shells can tilt or fold outwardly, whereby they are frictionally braked by the airstream so that the stack of projectiles is released. The known arrangement uses a fully enclosing shell casing or jacket for receiving and carrying the stack of projectiles in a known manner. Thus, the known multiple projectile ammunition shell requires costly, complicated, and time consuming production techniques to form a fully enclosing casing from two half shells with a two-piece foldable control fin arrangement, a shell nose cone, and a shell base plate carrying the hinges.

OBJECTS OF THE INVENTION

In view of the above it is the aim of the invention to achieve the following objects singly or in combination:

to simplify a multiple projectile ammunition shell, whereby a stack of projectiles itself forms the shell with very few additional holding members;

to reduce the production costs and manufacturing complexity of a multiple projectile ammunition shell;

to achieve varied distribution patterns or clusterings of projectiles released from such a multiple projectile ammunition shell, especially also defined plunge fire patterns;

to increase and to control selectively the firing range or maximum firing distance of such a multiple projectile ammunition shell; and to prevent the collision of projectile bodies after they are released from the multiple projectile shell in order to guarantee high functional reliability standards.

SUMMARY OF THE INVENTION

The above objects are achieved in a multiple projectile ammunition shell according to the invention by the following features. A stack of a plurality of projectiles is held together by flexible or springy flat holding bands which are bent around a front projectile in the firing direction. The flat bands extend lengthwise along the stack of projectiles and engage a rear projectile, the last one in the stack, by means of hook-shaped end portions or end hooks. Tensioning means tie together the end hooks of the flat bands. After the stack of projectiles forming a multiple projectile shell has been fired from the firing tube, the tensioning means are released thereby freeing the flat bands to flare open or spring radially outwardly, whereby the separate projectiles are released or freed. The bands have a radially outward spring bias.

The most important advantage of the invention is achieved quite simply by providing, in the simplest case, only two flat band springy holding members for holding together the stack of projectiles. The tensioning means may, for example, be a flammable textile or synthetic cord which burns away after the stack of projectiles has fired from a cannon or mortar. The stack of projectiles thus itself forms the shell without requiring costly or complicated additional components. According to the invention the separate projectiles remain together, even after ejection or firing, as a single projectile unit until the tensioning means are released at a desired time. Thus, a collision of the separate projectiles with each other is prevented, the firing range of the projectiles is increased and remains controllable, as desired. The impact distribution pattern of the projectiles may be controlled as desired by a selectively timed sequential partial release of the flat band springy holding members. The entire projectile stack forming a multiple projectile shell according to the invention may be constructed at a low cost from known materials in an inexpensive manner.

BRIEF DESCRIPTION OF THE DRAWINGS

In order that the invention may be clearly understood, it will now be described, by way of example, with reference to the accompanying drawings, wherein:

FIG. 5 is a perspective view, similar to that of FIG. 2, but showing a projectile stack including end plates and intermediate separating plates held together by two flat holding bands and alternative tensioning means which are to be cut by a cutting arrangement;

FIG. 6 is a detailed perspective view, for example from the upper right-hand corner of FIG. 5, showing a hooked clip connecting the flat holding band to the intermediate separating plate;

FIG. 7 is a detailed view similar to that of FIG. 6, but showing an alternative embodiment of holding hooks, including an engaging fixture for connecting the flat holding bands to the intermediate separating plates;

DETAILED DESCRIPTION OF PREFERRED EXAMPLE EMBODIMENTS AND OF THE BEST MODE OF THE INVENTION

Figures 1A, 1B, 1C, 1D:
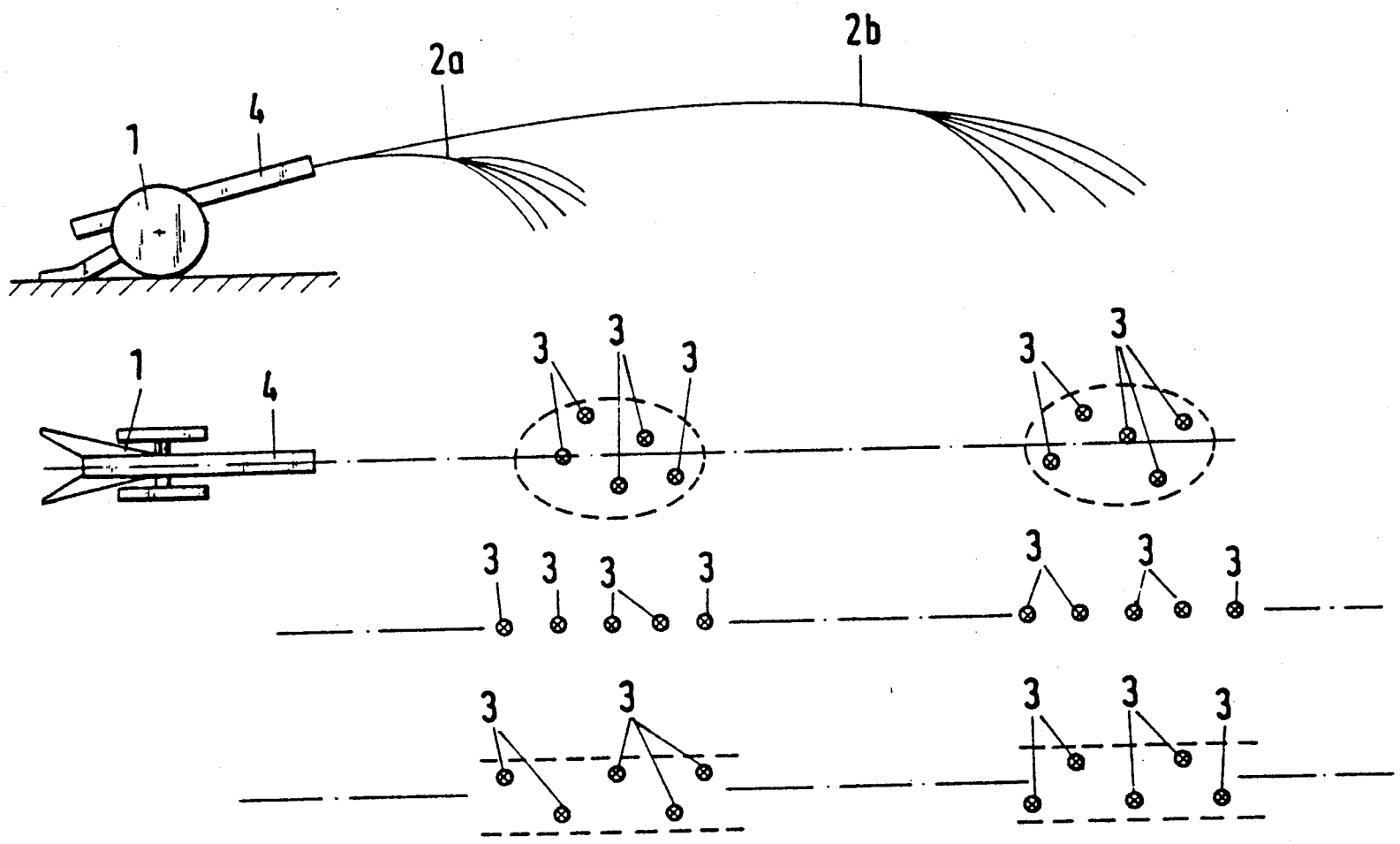
FIG. 1*a* is a schematic side view of a cannon capable of firing multiple projectile shells having two different firing ranges.
FIG. 1*b* is a top view of a cannon firing shells corresponding to FIG. 1*a*, showing a random elliptical scatter or clustering pattern of projectile impacts at two different firing ranges.
FIG. 1*c* is a top view corresponding to that of FIG. 1*b*, but showing a linear impact scatter distribution at two different firing ranges.
FIG. 1*d* is a top view corresponding to that of FIG. 1*d*, but showing a broad linear path scatter distribution of projectile impacts at two different firing ranges.

FIG. 1 shows a firing tube 4 of a cannon 1 or a mortar for firing multiple projectile ammunition shells, for example, at either of two firing ranges 2*a* or 2*b*. The multiple projectile shells according to the invention may similarly be fired from firing tubes attached to air vehicle or mounted in weaponry pods. Firing trajectory 2*a* represents an immediate opening or separation of the five projectiles of the multiple projectile shell, while firing trajectory 2*b* represents a delayed opening or separation of the five projectiles of the multiple projectile shell. FIG. 1*b* is a top view of the arrangement shown in FIG. 1*a*, showing an essentially random elliptical impact scatter pattern of the five projectiles 3 of the multiple projectile shell, according to the invention in either of two ranges 2*a* or 2*b*. FIG. 1*c* is a top view, similar to that of FIG. 1*b*, but shows a narrow linear impact pattern of the five projectiles 3 of the multiple projectile shell. FIG. 1*d* is also a top view, similar to that of FIG. 1*b*, but showing an impact pattern of the five projectiles 3, scattered over a wider linear path. In the following disclosure it will be described by what means and in what manner the impact scatter patterns shown in FIGS. 1*b* and 1*d* and the two firing ranges 2 and 2*b* may be achieved.

In the following Figures and examples each shell is shown to hold three projectiles 3 for the sake of a simplified illustration. However, it should be understood, that the multiple projectile shell according to the invention may comprise any suitable number of separate projectiles 3 stacked together to form the shell stack.

The actual number of projectiles 3 included in a shell may be selected as needed for the particular use and characteristics of the ammunition shell.

Figure 2:
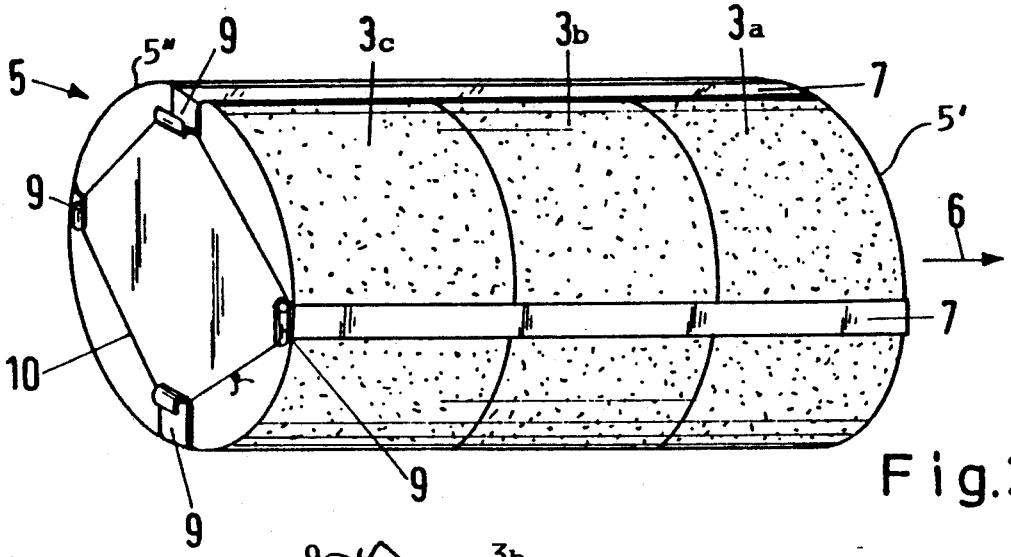
FIG. 2 is a perspective view of a projectile body stack forming a multiple projectile ammunition shell according to the invention having three stacked projectiles held together by four flexible flat bands which are clamped into engagement with the stack by a flammable tensioning means.

FIG. 2 shows a multiple projectile shell 5 according to the invention, ready to be fired from the firing tube 4 or a cannon 1 in the direction of an arrow 6. The three projectiles 3*a*, 3*b*, and 3*c* are stacked and held together by four flexible or springy flat bands 7 to form the multiple projectile shell 5. Each respective pair of flat bands 7 is interconnected at the head or front side 5′ by means of a cross-band 8 shown in FIG. 3. At the rear side 5″ of the shell 5 hooks 9 formed in the ends of the flat bands 7 engage the edge of the rear projectile 3*c*. A band or soft wire 10 forms a tensioning means which engages the four hooks 9 so that the hooks 9 and the bands 7 are pulled tightly against the projectiles 3. In addition to holding the stacked projectiles 3 together, the flat bands 7 may be appropriately treated or coated on their surface, for example, with a slippery plastic or synthetic material so that the flat bands 7 act as glide rails in the firing tube 4 of the cannon 1.

Figure 3:
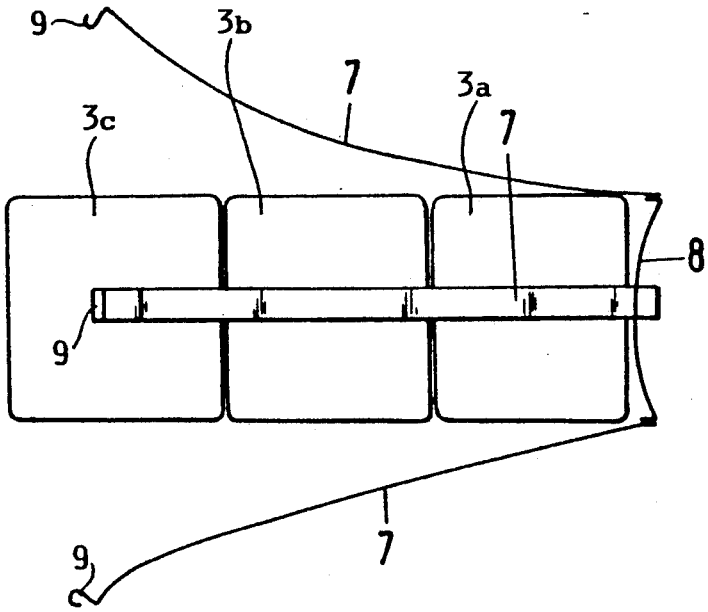
FIG. 3 is a schematic side view of a multiple projectile shell according to FIG. 2, after it has been fired from a cannon or other firing tube showing the flaring out of the flat bands after the tensioning means have been severed.

In the simple example embodiment shown in FIGS. 2 and 3, the tensioning means 10 holding the hooks 9 of the bands 7 tightly to the projectiles 3, is burned or melted through by the hot propellant gases developed during the firing. When the tensioning means 10 have been severed, the flat bands 7 under their own spring tension flare outwardly as shown in FIG. 3, immediately after the shell 5 leaves the firing tube 4. As soon as the flat bands 7 open in this manner the projectiles 3*a*, 3*b*, 3*c* are released to continue their trajectory separately. Therefore, in this embodiment the shell 5 follows the trajectory 2*a* shown in FIG. 1*a* and the separate projectiles impact the ground in a randomly scattered pattern, yet within an elliptical field as shown in FIG. 1*b*.

Figure 4:
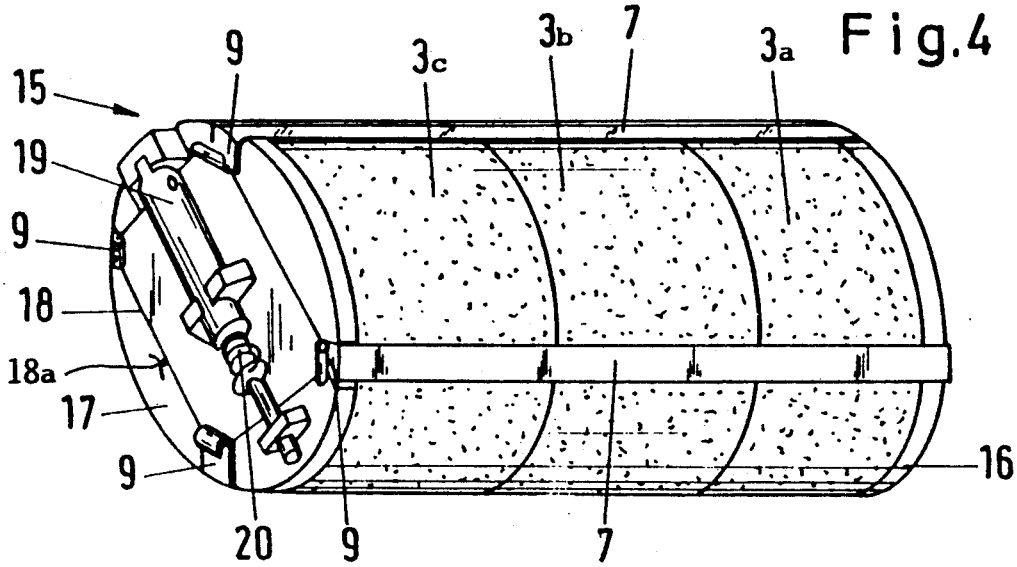
FIG. 4 is a perspective view, similar to that of FIG. 2, but showing a projectile stack including end plates and another embodiment of tensioning means which is to be cut by a cutting arrangement at an appropriate time for releasing the flat holding bands.

FIG. 4 shows a multiple projectile shell 15 comprising three projectiles 3*a*, 3*b*, and 3*c*, a front plate 16 and an end plate 17. Flat bands 7 similar to those described above hold the stack of projectiles 3 together including the plates 16 and 17. The tensioning means 18 holding together the hooks 9 of the flat springy bands 7 is a solid wire 18, which passes around all the hooks 9 and through a cutting device 19. The wire ends are twirled together at 18*a*. The cutting device 19 includes a cutting knife for severing the wire 18. Since the cutting device is known as such, it is not shown in detail. When the shell 15 leaves the firing tube 4, the operation of the cutting device 19 is initiated by uncocking a spring 20. As soon, as the cutting device 19 has cut the wire 18, the wire 18 is released from the hooks 9 whereby the flat bands 7 again spring or flare open to release the projectiles 3 as shown in FIG. 3. Therefore, the shell 15 shown in FIG. 4 follows the trajectory 2*a* shown in FIG. 1*a* and the projectiles 3 impact the ground in an elliptical scatter pattern as shown in FIG. 1*b*.

FIG. 5 shows a multiple projectile shell 25, comprising three projectile bodies 3*a*, 3*b*, and 3*c*, a front 16 and a rear plate 17 and two intermediate plates 26*a* and 26*b*. Two springy flat bands 7 hold the stack of projectiles and plates 16, 17; and the intermediate plates 26*a*, 26*b* together. A wire 28 forms a tension means for holding the hooks 9 of the flat bands 7 together. The wire 28 passes through a cutting device 27, which comprises a conventional delay composition pellet, which is ignited by the propellant gases at the time of firing the shell 25, whereby the wire 28 is melted through after a predetermined delay time to release the flat bands 7 to flare or spring open for releasing the separate projectiles 3*a*, 3*b*, and 3*c*. Due to the delay time, the shell 25 follows the firing trajectory 2*b* shown in FIG. 1*a* and the separate projectiles impact the ground in an elliptical scatter pattern as shown in FIG. 1*b*.

FIG. 6 is a detailed view of an arrangement for achieving a sequential release of the separate projectile 3*a*, 3*b*, and 3*c* rather than a simultaneous release of all three projectiles. For this purpose a hook element 29 straddles each flat band 7 behind the respective intermediate plate 26 and engages the intermediate plate 7 as shown in FIG. 6. In this manner the flat bands 27 are prevented from springing open fully at once when the tensioning means is released. Rather, sections of the flat bands flare open one after the other so that first only the rear projectile 3*c* is immediately released and is pulled away from the shell 25 by aerodynamic drag forces. Then, the rear intermediate plate 26*b* can be pulled free from the hook element 29 by aerodynamic drag forces, thereby releasing the next section of the flat bands 7 so that the middle projectile body 3*b* can be released. Thereafter, the front intermediate plate 26*a* is pulled free to fully release the last section of the flat bands 7 so that the front projectile body 3*a* is released. In this manner a nearly linear impact pattern of the separate projectiles on the ground may be achieved as shown in FIG. 1*c*. Such a linear scatter pattern may be achieved for either the short range trajectory 2*a* or the long range trajectory 2*b* shown in FIG. 1*a* depending on whether the tensioning means holding the hooks 9 of the flat bands 7 is released immediately or only after a time delay as described above.

FIG. 7 shows an alternative embodiment for achieving a sequential release of the successive projectiles 3*a*, 3*b*, . . . , similarly to the embodiment of FIG. 6, but further comprising an engaging fixture 30, which holds and supports the intermediate plate 26, whereby the hook elements 29 engage the fixture 30 for a certain release of the bands 7.

Figures 8A, 8B, 8C, 8D, 8E, 8F, 8G, 8H:
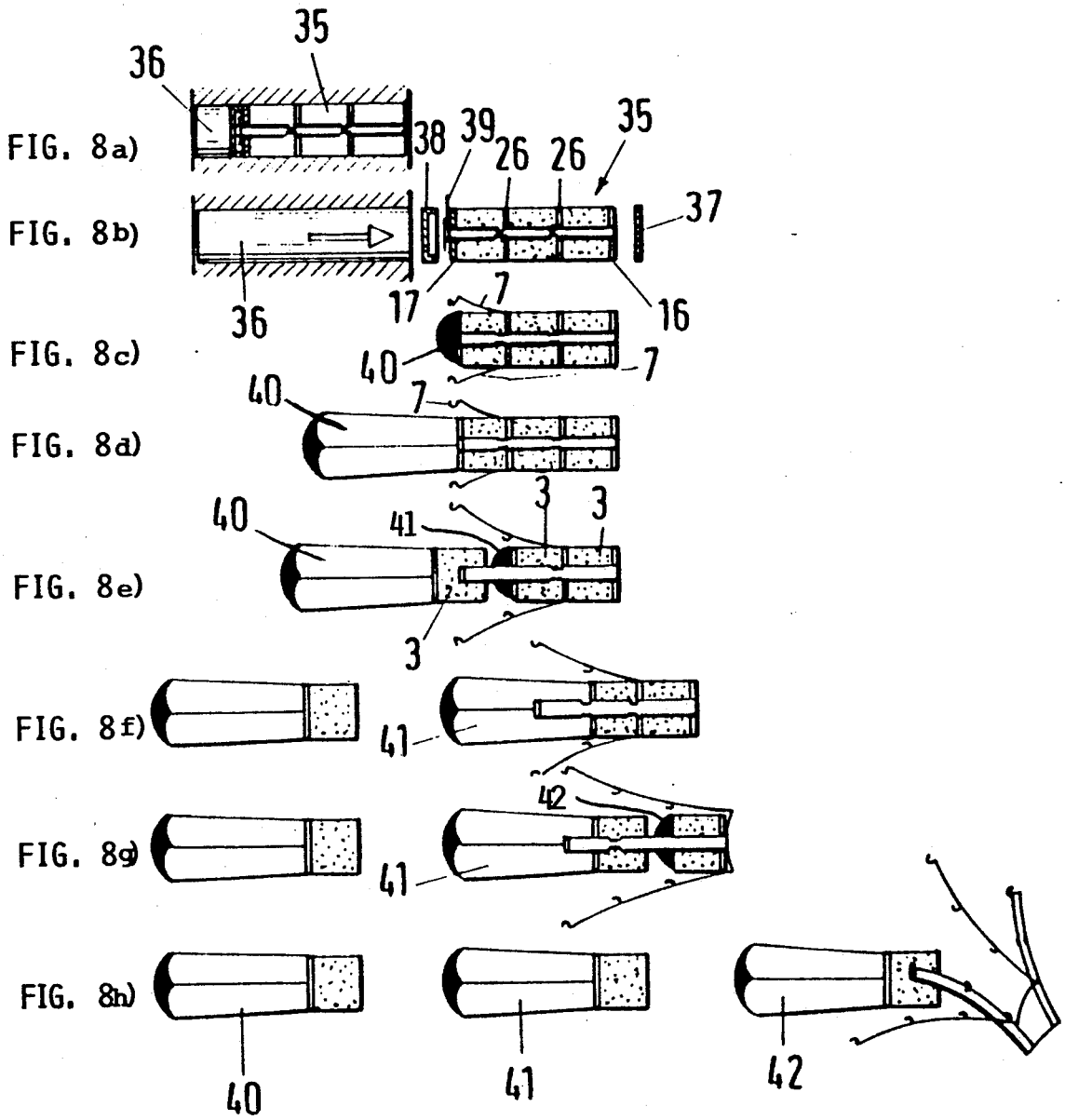
FIGS. 8*a* to 8*h* show steps in the time sequence of firing a multiple projectile shell from a firing tube and to individually free or deploy the projectile bodies from the shell to achieve a desired impact scatter or clustering pattern.
Figure 9:
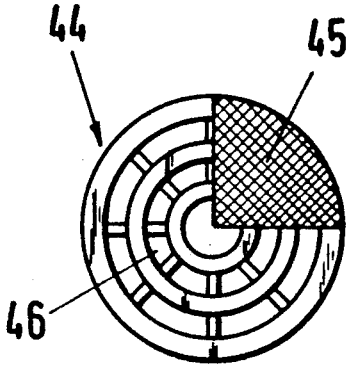
FIG. 9 shows a top view onto a parachute canopy for carrying a shell according to the invention wherein the canopy has an asymmetrical porosity or achieve air flow characteristic for a desired scatter pattern.

The several sequential views of FIGS. 8*a* to 8*h* show respective steps in the sequence of firing a multiple projectile shell 35 from a firing tube 36 and then releasing the separate projectiles 3, each of which is equipped with a parachute as will be described. In FIG. 8*a* the multiple projectile shell 35 is located in the firing tube 36. In FIG. 8*b* the shell 35 has just been fully expelled from the firing tube 36. A firing cap 37 at the head or nose of the multiple projectile shell 35 and a charge thrust plate 38 at the rear of the shell 35 have separated from the shell. A cutting device 39 merely shown schematically, has just cut through the tensioning means. As shown in FIG. 8*c*, end sections of the flat bands 7 have flared outwardly up to the point, where they are hooked into the rear intermediate plate 26 as described above with reference to FIGS. 6 and 7. A parachute 40 arranged in the end plate 17 begins to unfold. As shown in FIG. 8*d* the parachute 40 has fully opened. As shown in FIG. 8*e* the parachute 40 pulls the rear projectile away from the projectile stack out of the partly opened flat bands 7, whereby, the rear intermediate plate 26 is released so that a second parachute 41 is freed and begins to open. Thus, the next sections of the flat bands 7 are also released from the rear intermediate plate and spring outwardly to the extent permitted by the forward intermediate plate 26. As shown in FIG. 8*f* the second parachute 41 has fully opened and begins pulling out the middle projectile. As shown in FIG. 8*g* the parachute 41 has pulled the middle projectile from the shell 35, thereby releasing the forward intermediate plates, which frees a further parachute 42 and also fully releases the last section of the flat bands 7. As shown in FIG. 8*h* the third parachute 42 has fully opened and completely pulled the front projectile from the flat band holding members 7, which simply fall to the ground. Releasing projectile bodies 3 from a multiple projectile shell 35 in this manner achieves a linear distribution of the impact pattern of the projectiles bodies 3 on the ground as shown in FIG. 1*c*. It is possible to achieve a desired and appropriate delay while freeing the projectile bodies from the shell and while deploying the parachutes, for example, by varying the packing density of the parachutes in the respective packsacks by partially and temporarily gluing the parachute caps or canopies; by using reefing with pyrotechnic shroud line cutters, or by providing breakable connectors in the pull open lines of the parachutes, said connectors respond to different determined stresses for breaking sequentially. FIG. 9 is a top view of a parachute canopy 44 of which one quarter area comprises an airtight woven fabric 45 and of which three quarters comprise open annular ring surfaces 46. This construction provides an asymmetrical air permeability of the canopy 44, whereby a projectile 3 hanging from the parachute canopy 44 will be steered somewhat away from its firing direction. If the separate parachutes carrying the separate projectile bodies 3 are provided with airtight woven surface areas 45 on opposite or alternating sides, then the projectile bodies 3 will impact on the ground along a linear path scatter pattern as shown in FIG. 1*d*, providing a wider impact pattern compated to FIG. 1*c*.

Figure 10:
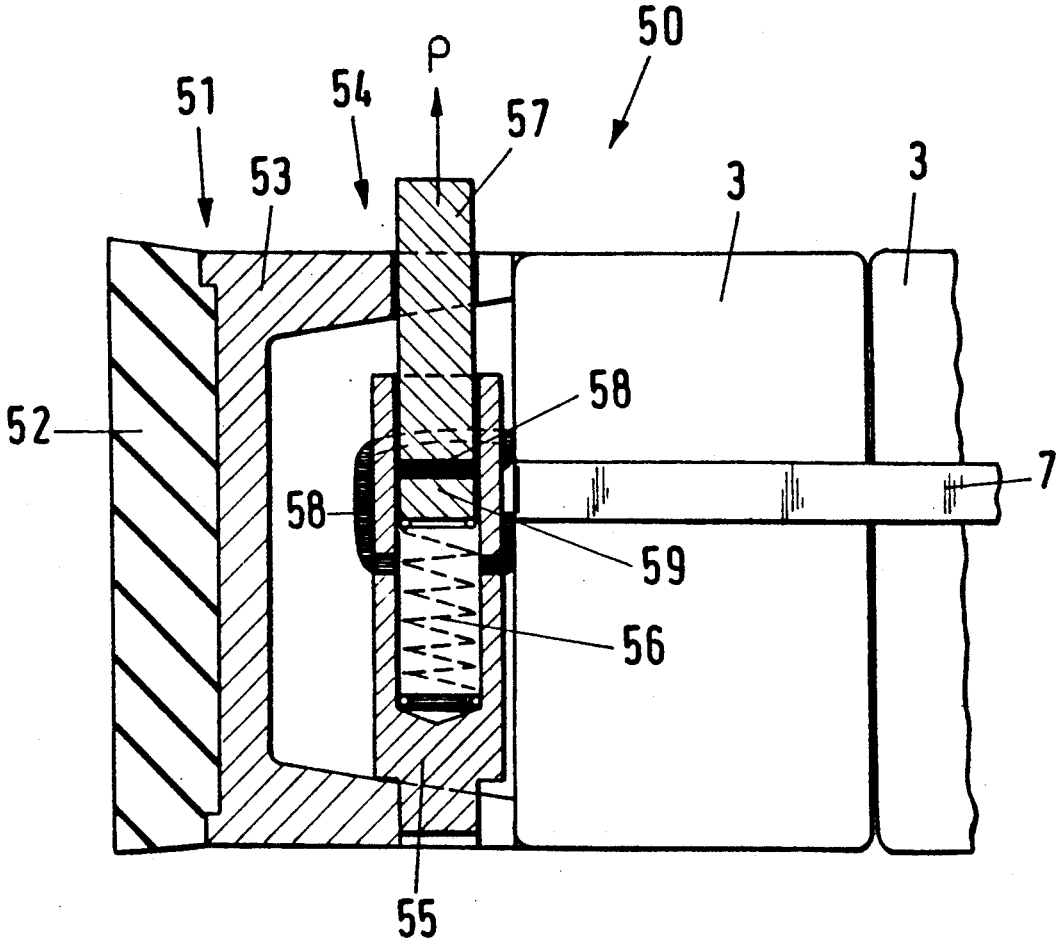
FIG. 10 an axial sectional view through a cartridge (sabot) with an integrated cutting arrangement for the tensioning means of a multiple projectile stack forming a multiple projectile shell.

FIG. 10 is a detailed partial view partly in section of the rear of a multiple projectile shell 50, whereby a sabot 51 pushes the projectile bodies 3 of the shell 50 out of the firing tube not shown. The sabot 51 and the shell 50 are shown in FIG. 10 just after leaving the end of the firing tube with the bands 7 still unreleased. The sabot 51 comprises a seal 52 against the explosive propellant gases from the firing tube chamber for preventing to fire the sabot 51 and the shell 50. The sabot 51 further comprises a dish 53 to which the seal 52 is attached. A cutting device 54 is located within the dish 53. The cutting device 54 has a cylindrical sleeve 55, wherein a piston 57 is slideably supported and biased in an outward direction by a spring 56. A band or wire 58 serving as the tensioning means is threaded through a hole in the cylindrical sleeve 55 and the piston 57. When the sabot 51 leaves the firing tube as shown in FIG. 10, the spring 56 drives the piston 57 outwardly as shown by the arrow P because the piston 57 is no longer held radially inwardly by the wall of the firing tube. When the spring 56 urges the piston 57 outwardly, a cutting edge 59 shears off the band or wire 58, releasing the hooks 9 and the flat spring bands 7 as described above/so that the rear projectile is released. A sabot 51 of this type may be used instead of the charge thrust plate 38 cooperating with the multiple projectile shell 35 shown in FIG. 8.

Although the invention has been described with reference to specific example embodiments, it will be appreciated that it is intended to cover all modifications and equivalents within the scope of the appended claims.

What we claim is:

1. An ammunition shell forming a stack of multiple projectiles for firing from a firing tube, comprising a plurality of projectiles including at least a front projectile and a rear projectile, as viewed in a firing direction, forming said stack, holding means including a plurality of springy, flexible flat holding bands initially holding said stack together, tensioning means for initially clamping together free ends of said holding bands and for then releasing said free ends at an appropriate time by permitting said springy, flexible flat bands to flare radially outwardly under their own spring bias to free said projectile bodies in a controlled manner, and wherein each of said holding bands comprises an essentially U-shaped configuration with an end bail and two lengthwise extending arms interconnected by said end bail, said end bail holding a front end of said stack, said lengthwise extending arms extending alongside said stack, each of said lengthwise extending arms having a bent hook at a free end of said lengthwise extending arm for engaging a rear end of said stack, said tensioning means normally engaging said hooks of said holding bands until said releasing.

2. The shell of claim 1, wherein said projectiles are arranged immediately adjacent one another in a stack, and are pressed together in said stack by said holding bands.

3. The shell of claim 1, further comprising a front plate arranged at a front end of said stack, and a rear plate arranged at a rear end of said stack, so that said front plate and said rear plate form part of said stack of said multiple projectiles.

4. The shell of claim 1, further comprising at least one intermediate plate arranged between neighboring of said plurality of projectiles, said holding bands further comprising intermediate hook elements hooking behind said intermediate plate to connect said intermediate plate to said holding bands.

5. The shell of claim 1, further comprising at least one intermediate plate arranged between neighboring projectiles of said plurality of projectiles said holding bands further including engaging fixtures engaging said intermediate plate to connect said intermediate plate to said holding bands.

6. The shell of claim 1, wherein said tensioning means comprise a flammable cord which is burned by expulsive gases generated when firing said shell.

7. The shell of claim 1, wherein said tensioning means comprise a meltable cord which is melted through by the heat generated when firing said shell.

8. The shell of claim 1, wherein said tensioning means comprise a solid material which is not meltable and flammable, but which may be cut by a release means for releasing said tensioning means.

9. The shell of claim 8, wherein said release means comprise a cutting blade, cutting blade operation means, and trigger means, which cooperate to activate a cutting motion of said cutting blade at an appropriate time after said shell has left said firing tube.

10. The shell of claim 9, wherein the cutting blade is operated by a spring means which operates on leaving of said firing tube.

11. The shell of claim 9, wherein said tripper means is initiated when the shell leaves the said firing tube, where this tripper initiates a delay means and where the said cutting blade is operated only after the such caused delay has passed.

12. The shell of claim 8, wherein said release means comprise pyrotechnical means for severing said tensioning means.

13. The shell of claim 12, wherein said pyrotechnical means are activatable immediately upon firing said shell from said firing tube.

14. The shell of claim 12, wherein said pyrotechnical means comprise time delay means for activating said pyrotechnical means only after a time delay after firing said shell from said first tube.

15. The shell of claim 1, wherein said holding bands comprise a treated surface layer to reduce a surface friction, whereby said holding bands act as glide rails in said firing tube.

16. The shell of clam 1, further comprising at least one parachute connected to a respective projectile of said plurality of projectiles whereby after said tensioning means are released, said parachute unfolds in an airstream and pulls said respective projectile from said stack.

17. The shell of claim 16, comprising a plurality of parachutes, whereby one parachute cooperates with each of said projectiles.

18. The shell of claim 17, wherein said parachutes are deployed with a delay.

19. The shell of claim 16, wherein said parachute comprises a canopy having an asymmetrical porosity to achieve a directed parachute travel trajectory, whereby a plurality of parachutes comprises a sequential alternating asymmetric porosity characteristic.

20. The shell of claim 1, further comprising a sabot arranged at a rear end of said shell, against which explosive propellant gases impinge in said firing tube.

21. The shell of claim 20, further comprising release means for said tensioning means, arranged in said sabot.

* * * * *

UNITED STATES PATENT AND TRADEMARK OFFICE

CERTIFICATE OF CORRECTION

PATENT NO. : 5,020,437

DATED : June 4, 1991

INVENTOR(S) : Ulrich Rieger et al.

It is certified that error appears in the above-identified patent and that said Letters Patent is hereby corrected as shown below:

TITLE PAGE:

In the Abstract [57], line 6, replace "rare" by --rear--;
line 9, replace "served" by --severed--;

In claim 4, line 2, column 7, line 18, after "neighboring" insert --projectiles--;

Claim 5, line 3, column 7, line 25, after "projectiles" insert --,--;

Claim 14, line 4, column 8, line 18, replace "first" by --firing--;

Claim 16, line 1, column 8, line 23, replace "clam" by --claim--;
line 3, column 8, line 25, after "projectiles" insert --,--.

Signed and Sealed this

Twenty-second Day of September, 1992

*Attest:*

DOUGLAS B. COMER

*Attesting Officer*

*Acting Commissioner of Patents and Trademarks*